US007310827B2

(12) United States Patent
Ciesinski et al.

(10) Patent No.: US 7,310,827 B2
(45) Date of Patent: Dec. 25, 2007

(54) SPLASH GUARD

(75) Inventors: Martin J. Ciesinski, 22 Cousins St., Northport, NY (US) 11768; Chris J. Dowhie, Whitestone, NY (US)

(73) Assignee: Martin J. Ciesinski, Northport, NY (US)

( * ) Notice: Subject to any disclaimer, the term of this patent is extended or adjusted under 35 U.S.C. 154(b) by 170 days.

(21) Appl. No.: 11/262,872

(22) Filed: Oct. 31, 2005

(65) Prior Publication Data

US 2007/0094770 A1 May 3, 2007

(51) Int. Cl.
*A42B 1/00* (2006.01)

(52) U.S. Cl. ..... 2/174; 132/212

(58) Field of Classification Search ..... 2/171, 2/174, 67, 68, 84, 88, 410, 171.03, 171.1, 2/172, 181.4, 202, 204, 205, 207, 209, 918; 132/200, 212
See application file for complete search history.

(56) References Cited

U.S. PATENT DOCUMENTS 3,996,946 A * 12/1976 Craig ..... 132/212
5,249,308 A * 10/1993 Blume ..... 2/174
5,566,689 A * 10/1996 Yeater ..... 132/212
5,950,236 A * 9/1999 Andrew et al. ..... 2/50
6,434,752 B1 * 8/2002 Adams ..... 2/171

* cited by examiner

*Primary Examiner*—Tejash Patel
(74) *Attorney, Agent, or Firm*—Myron Greenspan; Myron Greenspan Lackenbach Siegel LLP

(57) ABSTRACT

A crescent-shaped splash guard, encircling the part of the head to be washed, protects the eyes, ears and nose from soap and other solutions. It is placed centrally on the forehead above the eyes. Two opposing side portions extend from the center to above and behind the ears. The side portions form upper and lower edges providing a seal against the head. The side portions form troughs about the periphery, directing water and hair washing solutions to the side and back, and preventing solutions from dripping into the eyes, nose and ears. A handgrip in the splash guard's center provides a grip for a "hairwasher." Holding the handgrip prevents the splash guard from shifting. The "hairwasher" applies pressure to the splash guard via the handgrip to ensure that all hair solutions are guided through the troughs and discharged away from the eyes, nose and ears.

11 Claims, 3 Drawing Sheets

SPLASH GUARD

BACKGROUND OF THE INVENTION

1. Field of Invention

The present invention generally relates to a hairwashing apparatus, and more specifically to a splash guard for protecting a person's eyes, ears and nose from soap and other hairdressing preparations, such as shampoo.

2. Description of the Prior Art

Soap guards and face protective shields or visors have been known. They are normally provided to guard against water, soap, or shampoo from entering the eyes, nose and ears of the person whose hair is being washed. While such devices have conventionally been considered to be "beauty shop" equipment, it has also become of interest to protect against irritation, inconvenience and possible detrimental effects of soap or hairdressing preparations entering the eyes, nose or ears when hair is washed in the home and shampooing fluids, for example, trickle down the face causing unnecessary inconvenience and annoyance, including wetting items of clothing. While a number of known splash guards or shields include visors that can in theory be held or gripped by a person doing the washing, these are not designed for that purpose and are difficult to grip, particularly in the presence of water, soap and other hair washing preparations that tend to make them wet and slippery. Attention is directed, for example, to the following U.S. patents:

1. U.S. Pat. No. 772,763 to Walters;
2. U.S. Pat. No. 2,424,352 to Conjurske;
3. U.S. Pat. No. 2,600,392 to Cancell;
4. U.S. Pat. No. 4,481,680 to Mason et al.; and
5. U.S. Pat. No. 5,857,218 to Kuhlman et al.;
6. and U.S. Pat. No. 6,584,984 and U.S. Patent Publication No. 2002/0129831, both to Kelly.

The '763 patent is for a mounted device with a full head ring, a wide front visor and a chute-type rear drape. The '352 patent is for a flexible padded horseshoe band with a wide visor and ear cups. The '392 patent is for a device similar to the '763 device. The '680 patent is for an adjustable head-ring-type visor with a gutter that drains to the rear. The '218 patent is for a horseshoe shaped visor made of foam and with a rear clamp. The '984 patent and '831 patent application are for horseshoe shaped headbands with a gutter that drains to the rear.

However, the problem with the known shields or splash guards is that they do not include a handle or hand grip that can be conveniently and firmly gripped by the person doing the washing so that the device can be properly stabilized and held in place, even in a wet and slippery environment, and so that adequate pressure can be applied to the splash guard to maintain it on the head of a child, for example, even if the child moves or is less than fully cooperative while the child's hair is being washed.

SUMMARY OF THE INVENTION

Accordingly, it is an object of the invention to provide a splash guard that is simple in construction and economical to manufacture.

It is still another object of the invention to provide a splash guard that is easy and convenient to use.

It is still another object of the invention to provide a splash guard that is effective in keeping water, soap and other irritating hairwashing preparations out of the eyes, nose and ears of a person whose hair is being washed.

It is still another object of the invention to provide a splash guard as in the aforementioned objects that includes a handgrip or handle that can be conveniently and effectively gripped to maintain the desired position of the splash guard on the head of the person whose hair is being washed notwithstanding the fact that the splash guard and/or the handgrip itself may be wet or slippery.

It is yet another object of the invention to provide a splash guard of the type of the discussion that includes outward extensions of the lateral portions thereof extending above the ear for accommodating at least a portion of the ears to render the splash guard more comfortable while providing a seal about the entire periphery wherein contact takes place between the splash guard and the skin of the person whose hair is being washed.

In order to achieve the above objects, as well as others which will become apparent hereinafter, a splash guard in accordance with the present invention for protecting a person's eyes, nose and ears from soap and other hairdressing preparations, such as shampoo, applied to a person's hair includes a generally crescent or U-shaped member formed and dimensioned to generally conform to and circumferentially encircle a part of the head of the first person whose hair is to be washed and having a central portion positioned on the first person's forehead above the person's eyes. First and second opposed arcuate side or lateral portions extend from the central portion to a position above and rearwardly of the person's ears. The central and lateral portions generally define upper and lower edges when supported on the head of the person whose hair is being washed. Sealing means are secured to an inner surface of the member proximate to the lower edge and at least partially spaced from the upper edge in extending substantially along the entire peripheral distance of said member for providing a seal about the peripheral distance with the skin of the first person along the entire length of contact and having a thickness to form a trough about said peripheral distance to direct water and soap and hair preparations laterally and rearwardly away from said central portion and not downwardly drip towards the eyes, nose and ears of the first person along the area of contact of said sealing means. A handgrip is provided on said central portion dimensioned to be easily gripped by a second person washing the hair of the first person. In this manner, the second person can secure the splash guard on the head of the first person in a desired position to prevent excessive shifting of the splash guard while the first person's hair is being washed and can apply suitable pressure on said member to ensure that hair washing preparations flow through and are discharged along regions behind the first person's ears.

BRIEF DESCRIPTION OF THE DRAWINGS

Various further objects, features and attendant advantages of the present invention will be fully appreciated as the invention is better understood in light of the accompanying figures, in which like reference numbers or characters designate the same or similar parts within the figures, and wherein.

DESCRIPTION OF THE PREFERRED EMBODIMENTS

Figure 1:
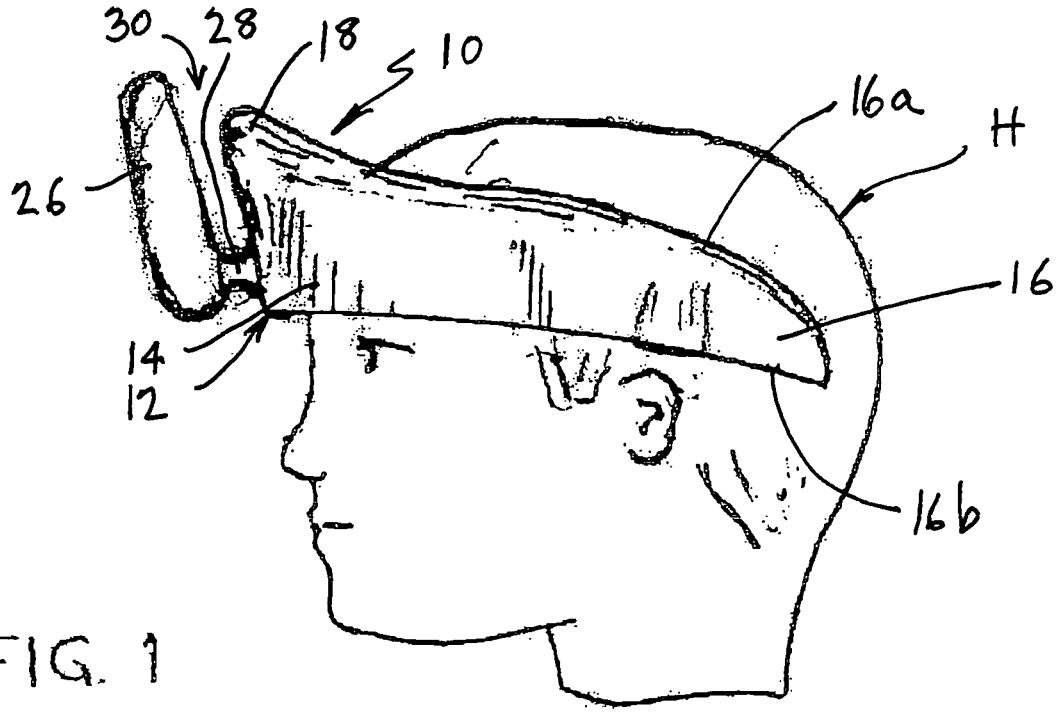
FIG. 1 is a side elevational view of a splash guard in accordance with the present invention, as shown supported on the head of a person whose hair is about to be washed.

Referring specifically to the figures, in which identical or similar parts are designated by the same reference numerals throughout, and first referring to FIG. 1, a splash guard in accordance with the present invention is generally designated by the reference numeral 10. The splash guard is designed and adapted for protecting a person's eyes, nose and ears from soap and other hairdressing preparations, such as shampoo, applied to a person's hair while it is being washed.

The splash guard 10 includes a generally crescent-shaped or U-shaped member 12 which is formed and dimensioned to generally conform to and circumferentially encircle a part of the head of a person whose hair is to be washed. It is contemplated, therefore, that such a splash guard can be formed in one or more different sizes to accommodate the heads of children as well as adults.

Figure 2:
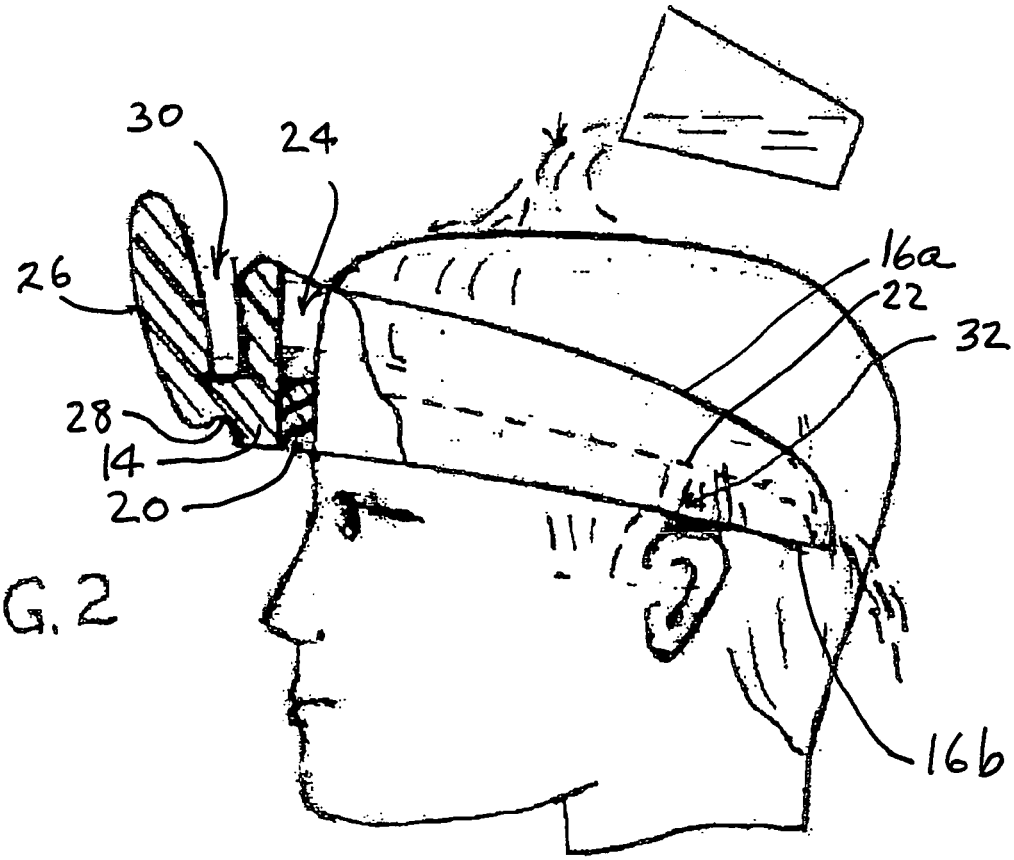
FIG. 2 is similar to FIG. 1 but showing the splash guard partially broken away to show the internal trough or channel that is created between the splash guard and the head of the person wearing the splash guard, and furthermore showing water being poured on the person's head and water running off and being discharged at the rear of the person's head behind the ears.
Figure 4:
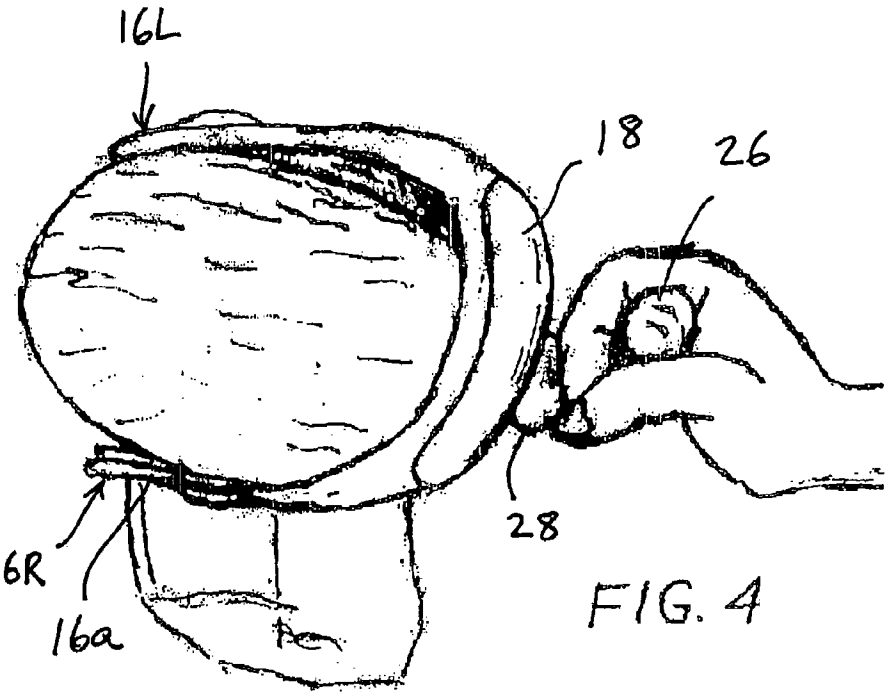
FIG. 4 is a top plan view of the splash guard as supported on the head of the person whose hair is being washed and also showing the handle being gripped by the person washing the hair to secure the splash guard in place and making sure that a proper and complete seal is developed between the splash guard and the head.
Figure 3:
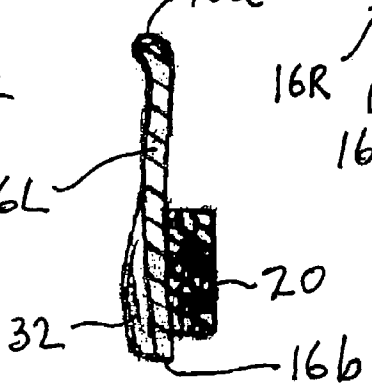
FIG. 3 is the cross-sectional view of one of the arcuate lateral side portions of the splash guard, taken along line 3-3.
Figure 5:
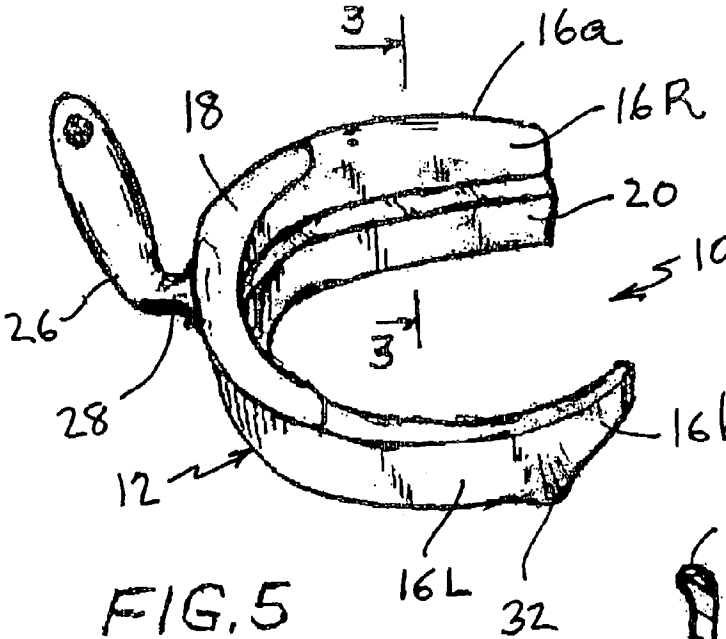
FIG. 5 is a perspective view of the splash guard as shown in FIG. 4.
Figure 6:
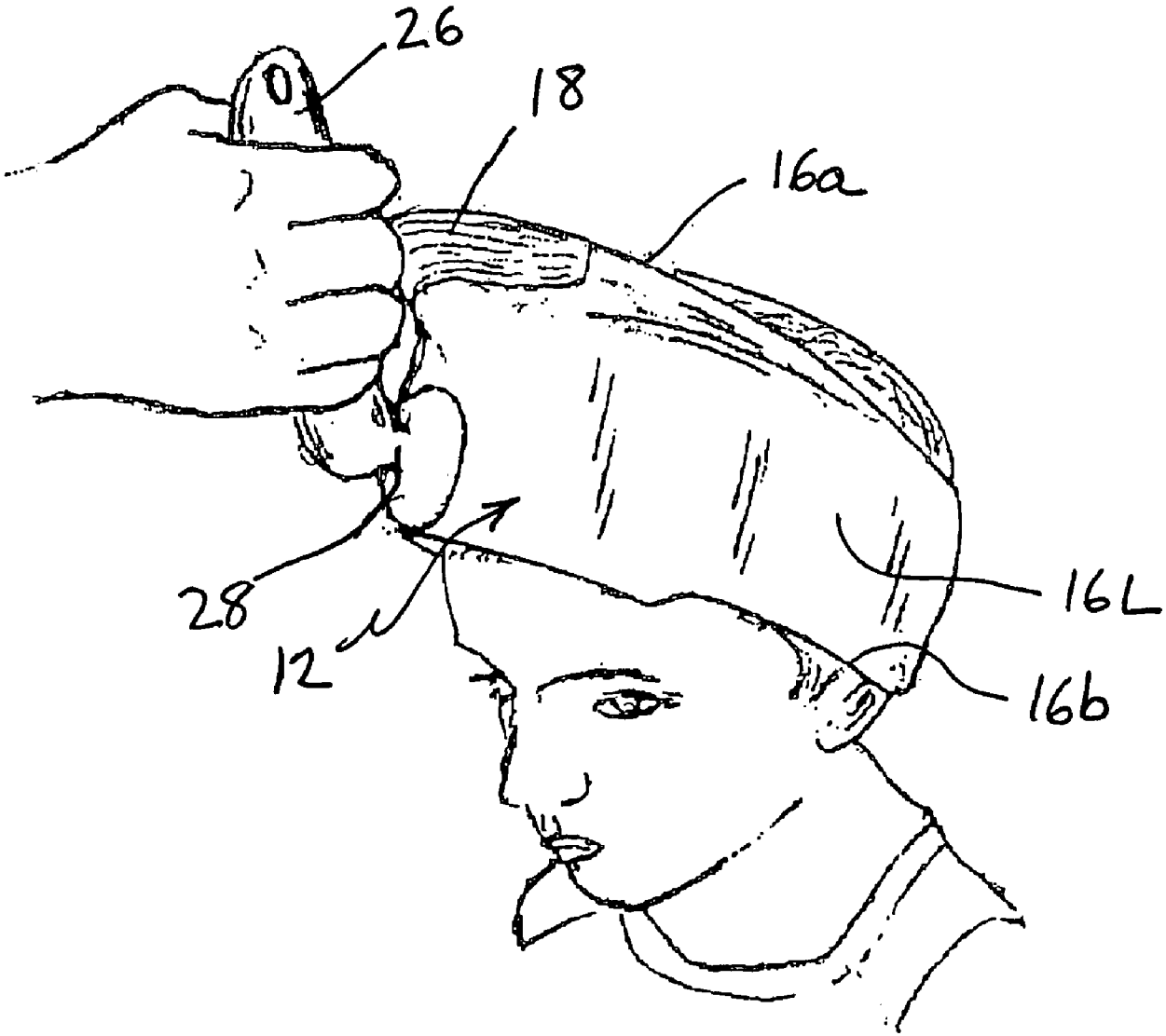
FIG. 6 is a perspective view of the splash guard as shown in FIG. 4 showing the general orientation of the splash guard and the relative position of the handle for conveniently gripping and supporting the splash guard in a desired orientation.

The member 12 has a central portion 14 dimensioned to be positioned on the person's forehead above the person's eyes as is shown in FIGS. 1 and 2. The member 12 is also provided with first and second opposed arcuate lateral or side portions 16R, positioned along the right side of the person's head, and 16L positioned on the left side of the person's head, generally extending along the temples of the head. As indicated, the opposed arcuate side or lateral portions 16R, 16L extend from the central portion 14 to a position above and rearwardly of the person's ears.

The portions 14, 16R and 16L, together forming the member 12, generally define an upper edge 16*a* and lower edge 16*b* when supported on the person's head, these portions simulating, in cross-section, a generally upright arcuate wall, as best as shown in FIG. 2. As will be more fully discussed hereinafter, the portions forming the member 12 may be provided with various enhancements and surface features that are optional insofar as the operation of the splash guard is concerned. In FIGS. 1 and 2, the central portion 14 is shown to be provided with an enlarged or upwardly projecting portion 18 to prevent spillage of water on the face when water is poured on the head.

A seal 20 is provided and secured to an inner surface of the member 12 proximate to the lower edge 16*b* and at least partially spaced from the upper edge 16*a*, and extends substantially along the entire peripheral distance of the member 12 for providing a seal about such peripheral distance with the skin of the person along the entire length of contact. A feature of the invention is that the seal has a sufficient or adequate thickness to form a trough 24 about the peripheral distance to direct water and soap and hair preparations laterally away from the central portion 14 while preventing downward dripping towards the eyes, nose and ears of the person along the area of contact of the seal.

In a preferred embodiment of the invention, the member 12 is produced as a molded member of relatively rigid but somewhat flexible material, such as plastic, so that the lateral portions 60R and 60L can be at least slightly deflected outwardly when the splash guard is placed on the head and subsequently resiliently spring back in order to apply a gentle but retaining force to maintain the unit in place on the head of the person. The seal 14, in this regard, is preferably a continuous strip of compressible material, such as foam, that conforms to the specific shape of the head and compensates for any deviations between the shape of the head and the shape of the member 12.

An important feature of the invention is that there is provided a handgrip or handle 26 mounted on the central portion 14 by means of a post or spacer 28, the handgrip or handle 26 being configured and dimensioned to be easily gripped by a person doing the washing of the hair of the person wearing the splash guard. The spacer is provided, as shown, between the central portion 14 and the handgrip or handle 26 to space the handgrip from the central portion and create a clearance or space 30 suitable for receiving and accommodating the fingers of the person gripping the splash guard. By providing such a space 30, the person that is doing the washing can grip the handgrip or handle by encircling his or her fingers about it with comfort and convenience. In the present preferred embodiment illustrated, the spacer or post 28 is provided proximate to the lower edge 16*b*, with the handgrip or handle projecting upwardly from the spacer. The handgrip or handle is generally elongate and, in the preferred embodiment, extends generally away from the central portion in a direction away from the spacer 28. However, it should be clear that the described construction is not critical and any suitable handgrip or handle can be provided and attached to any portion of the member 12, so long as it can be suitably gripped to control the position of the splash guard on the head of the person whose hair is being washed, notwithstanding that the splash guard including the handle or handgrip may be wet and slippery. However, irrespective of where the handle is placed or its specific configuration, it should have the ability to perform two functions. Firstly, it should allow the person doing the washing to reliably secure the splash guard and maintain it in a desired position and move it as necessary with movements of the head, so that the splash guard is normally or typically maintained in the same relative position shown in the figures. Secondly, however, the handle should be arranged such that the person administering the washing can apply a gentle but adequate pressure on the member 12 to ensure that the seal created by the strip of sponge material 20 is maintained while not excessively compressing the sealing material 20 as this might create discomfort to the person wearing the splash guard as well as excessively reduce the dimensions of the trough 24. If the size of the trough is excessively decreased and water cannot run off or be discharged quickly enough, the level of water in the trough may rise excessively and spill over the upper edge 16*a*, thereby defeating the purpose of the splash guard.

According to another feature of the invention, each of the arcuate or lateral side portions 16R, 16L are provided with an outward extension 32 in the region of the lower edge 16*b* of each of the lateral side portions to at least partially accommodate the ears of the person whose hair is being washed. By deflecting outwardly in this manner, the protrusions 32 also assist in providing a continuous seal and a substantially uniform trough 24.

An optional feature of the invention is providing at least one decorative element on the member 12 to simulate a different object. One object may be one that is normally worn on the head, such as a crown. However, such decorative elements may simulate, for example, the shape of an animal figurine, a cartoon character, a sports team logo etc.

As will be evident from the above description, the splash guard in accordance with the present invention can be easily used both by hairdressers in a salon as well as by a parent at home to wash the hair of a child without exposing the child to irritating and unpleasant exposure to soap, shampoos, and other hair grooming chemicals and products.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

The invention claimed is:

1. A splash guard for protecting a person's face and ears from soap and other hairdressing preparations, such as shampoo, applied to a person's hair comprising a generally crescent shaped member formed and dimensioned to generally conform to and circumferentially encircle a part of the head of a first person while exposing the first person's hair to be washed and having a central portion positioned on the first person's forehead above the person's eyes and having first and second opposed arcuate side portions each extending along the lateral sides of the head from said central portion to a position above and rearwardly of the first person's ears, said portions generally defining upper and lower edges when supported on the first person's head; sealing means secured to an inner surface of said member proximate to said lower edge and at least partially spaced from said upper edge and extending substantially along the entire peripheral distance of said member for providing a seal about said peripheral distance with the skin of the first person along the entire length of contact and having a thickness to form a trough about said peripheral distance to direct water and soap and hair preparations laterally and rearwardly away from said central portion and not downwardly drip towards the eyes, nose and ears of the first person along the area of contact of said sealing means; and a handgrip on said central portion dimensioned to be easily gripped by a second person washing the hair of the first person, whereby the second person can secure the splash guard on the head of the first person in a desired position to prevent excessive shifting of the splash guard while the first person's hair is being washed and can apply suitable pressure on said member to insure that hair washing preparation flow through the trough and be discharged along regions behind the first person's ears.

2. A splash guard as defined in claim 1, wherein said member is a molded plastic member.

3. A splash guard as defined in claim 1 wherein said sealing means comprises a continuous strip of compressible material.

4. A splash guard as defined in claim 3, wherein said material is compressible foam material.

5. A splash guard as defined in claim 1, wherein each of said arcuate side portions has an outward extension in the region of said lower edge to accommodate the ears of the first person and to provide a continuous seal and a substantially uniform trough width.

6. A splash guard as defined in claim 1, further comprising spacer between said central portion and said handgrip to space said handgrip from said central portion and create a clearance for the fingers of the second person whereby the second person can grip the handgrip by encircling the fingers about the handgrip.

7. A splash guard as defined in claim 6, wherein said spacer is provided proximate to said lower edge, and said handgrip projects upwardly from said spacer.

8. A splash guard as defined in claim 7, wherein said handgrip is generally elongate.

9. A splash guard as defined in claim 8, wherein said handgrip extends generally away from said central portion in the direction away from said spacer.

10. A splash guard as defined in claim 1, further comprising a decorative element on said member to simulate a different object normally worn on the head.

11. A splash guard as defined in claim 10, wherein said decorative element is provided at least partially along said upper edge of said central portion.

* * * * *